US005417134A

United States Patent [19]

Fitz, Jr.

[11] Patent Number: 5,417,134

[45] Date of Patent: May 23, 1995

[54] APPARATUS FOR LATERALLY POSITIONING FLAT CABLE

[75] Inventor: Charles E. Fitz, Jr., Harrisburg, Pa.

[73] Assignee: The Whitaker Corporation, Wilmington, Del.

[21] Appl. No.: 159,352

[22] Filed: Nov. 30, 1993

[51] Int. Cl.[6] ..... B26D 7/06

[52] U.S. Cl. ..... 83/446; 83/449; 83/686; 269/254 CS

[58] Field of Search ..... 269/254 CS, 254 R, 250–253, 269/111, 218, 221; 279/133, 2.16; 254/10 R, 10 B, 10 C; 83/684–690, 449, 446

[56] References Cited

U.S. PATENT DOCUMENTS

| | | | |
|---|---|---|---|
| 1,117,024 | 11/1914 | Gathright | 269/256 |
| 1,423,933 | 7/1922 | Heatlie | 269/256 |
| 2,241,021 | 5/1941 | Riebe | 269/256 |
| 2,756,822 | 7/1956 | Jones | 83/446 |
| 4,252,303 | 2/1981 | Shimai | 269/256 |
| 4,452,118 | 6/1984 | Muller | 83/446 |
| 4,476,757 | 10/1984 | Morris | 83/446 |
| 4,480,181 | 10/1984 | Fisher | 269/256 |

*Primary Examiner*—Robert C. Watson
*Attorney, Agent, or Firm*—Robert J. Kapalka

[57] ABSTRACT

An apparatus for laterally positioning flat cable in a machine for performing an operation on the cable comprises a base and a pair of cable guides which are movable with respect to the base. Each of the cable guides has a cable guide surface configured complementary to a respective cable side edge. The cable guide surfaces are in opposing relationship. A linkage is connected for moving the cable guide surfaces convergently and divergently through respective proportional distances on opposite sides of a target plane of convergence between the cable guide surfaces. When the cable guide surfaces are spaced apart at a distance equal to or greater than the cable width and the cable is introduced between the cable guide surfaces, operation of the linkage so as to move the cable guide surfaces convergently causes the cable to become confined between the cable guide surfaces with the cable longitudinal axis aligned parallel to the target plane.

14 Claims, 5 Drawing Sheets

APPARATUS FOR LATERALLY POSITIONING FLAT CABLE

FIELD OF THE INVENTION

The invention relates to an apparatus for laterally positioning sections of flat cable having different widths in a machine which performs an operation on the cable sections.

BACKGROUND OF THE INVENTION

Various types of flat cable are known for use in electrical circuits. Flat cable such as ribbon cable has a plurality of conductors disposed in side-by-side spaced relationship and enclosed in an insulative sheath. Another type of flat cable known as flat power cable is entering commercial use for transmitting electrical power of, for example, 75 amperes nominal. Such flat power cable is about one inch wide and may comprise a single flat conductor such as 0.020 inch thick copper or aluminum with an insulative coating of between 0.004 and 0.008 inch thickness extruded therearound. Also entering commercial acceptance is a dual conductor flat power cable, wherein a pair of co-planar flat conductor strips having insulation extruded therearound define power and return paths for electrical power transmission. The dual conductor strips are spaced approximately 0.100 inch apart, and the insulation which surrounds the strips also fills the gap therebetween.

Electrical connectors are known for terminating dual conductor flat power cable. U.S. Pat. No. 4,915,650 discloses an electrical connector for terminating an end of a dual conductor flat power cable, the terminated end being matable with a corresponding terminated end of another cable, or with a bus bar or power supply, for example. U.S. Pat. No. 5,219,303 discloses a connector for interconnecting a pair of dual flat power cables at a location along a continuous length of at least one of the cables.

The connectors disclosed in the above-referenced patents include terminal assemblies having upper and lower plate sections defining opposed cooperative arrays of conductor engaging members which receive the dual conductor flat power cable therebetween. Prior to terminating a cable, a slot is punched in the cable along its median, thereby removing a short length of the insulative coating between the conductor strips. The terminal assembly is applied to the cable by pressing together the upper and lower plate sections, whereby the conductor engaging members pierce the dual conductor strips of the cable and become interengaged. In a simultaneous operation, central ligatures of the upper and lower plate sections are severed, thereby providing discrete terminals corresponding to the two conductors of the dual power cable so as to enable separate connections to discrete circuits. A dielectric housing is ultimately applied to the terminals to seal out dirt and enable connection to mating terminated cable.

The above-described operation of punching a slot in the cable requires a close tolerance on the position of the slot, for example, the center of the slot to be within 0.010 inch of true position of the center of the cable. If the slot is not positioned within tolerance, the slot will extend unacceptably into one of the dual conductor strips, thereby reducing a width of the strip and preventing secure engagement of the strip by the conductor engaging members of the terminal assembly to be applied.

A machine for punching the slot typically includes a track in which the cable is inserted to position the cable with respect to a punch press. In prior art machines, the track comprises a pair of fixed guides having opposed cable guide surfaces which are spaced apart by a width of the cable so that the cable can be received therebetween. When the cable is centered between the guide surfaces, the median of the cable is aligned with the punching die so that a slot can be punched centrally through the cable. However, there is a manufacturing tolerance on the cable width and, in order for the track to accommodate all cable widths, the guide surfaces are spaced apart by a fixed distance equal to a cable width at the high end of its tolerance range. For example, a typical cable having a width of 1.012 plus or minus 0.013 inch requires the track to have guide surfaces spaced 1.025 inch apart. This results in a problem in that when a cable having a width at the low end of its tolerance range is inserted into the track, the cable has a substantial clearance between the guide surfaces and can not be accurately centered in the track, thereby preventing accurate punching of the slot in the cable. The present invention overcomes this problem by providing a lateral positioning apparatus having an adjustable track width so that cables having different widths may be accurately positioned laterally in a machine for punching a slot in the cable or for performing some other operation on the cable.

SUMMARY OF THE INVENTION

The present invention provides an apparatus for laterally positioning a flat cable in a machine for performing an operation on the cable. The cable is of a type which has a width extending between substantially parallel opposite side edges which define a cable plane and a longitudinal cable axis. The apparatus comprises a base and a pair of cable guides which are movable with respect to the base. Each of the cable guides has a cable guide surface configured complementary to a respective one of the cable side edges, the cable guide surfaces being in opposing relationship. A linkage is connected for moving the cable guide surfaces convergently and divergently through respective proportional distances on opposite sides of a target plane of convergence between the cable guide surfaces. When the cable guide surfaces are spaced apart at a distance equal to or greater than the cable width and the cable is introduced between the cable guide surfaces, operation of the linkage so as to move the cable guide surfaces convergently causes the cable to become confined between the cable guide surfaces and the cable axis to become aligned parallel to the target plane.

According to one embodiment of the invention, the linkage includes a pair of links each having a mid-portion pivotally connected to the base about a respective link pivot axis, the link pivot axes extending in a link pivot plane which is parallel to the target plane. Further, the pair of cable guides each have a pair of spaced apart pivotal connections defining a pair of cable guide pivot axes, and each of the pivotal connections couples one of the cable guides to one of the links about its respective cable guide pivot axis. The pairs of cable guide pivot axes are in respective planes on opposite sides of the link pivot plane and parallel thereto. Pivoting of the links about their respective link pivot axes moves the cable guide surfaces convergently and divergently through respective proportional distances.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION OF THE PREFERRED EMBODIMENT

Figure 1:
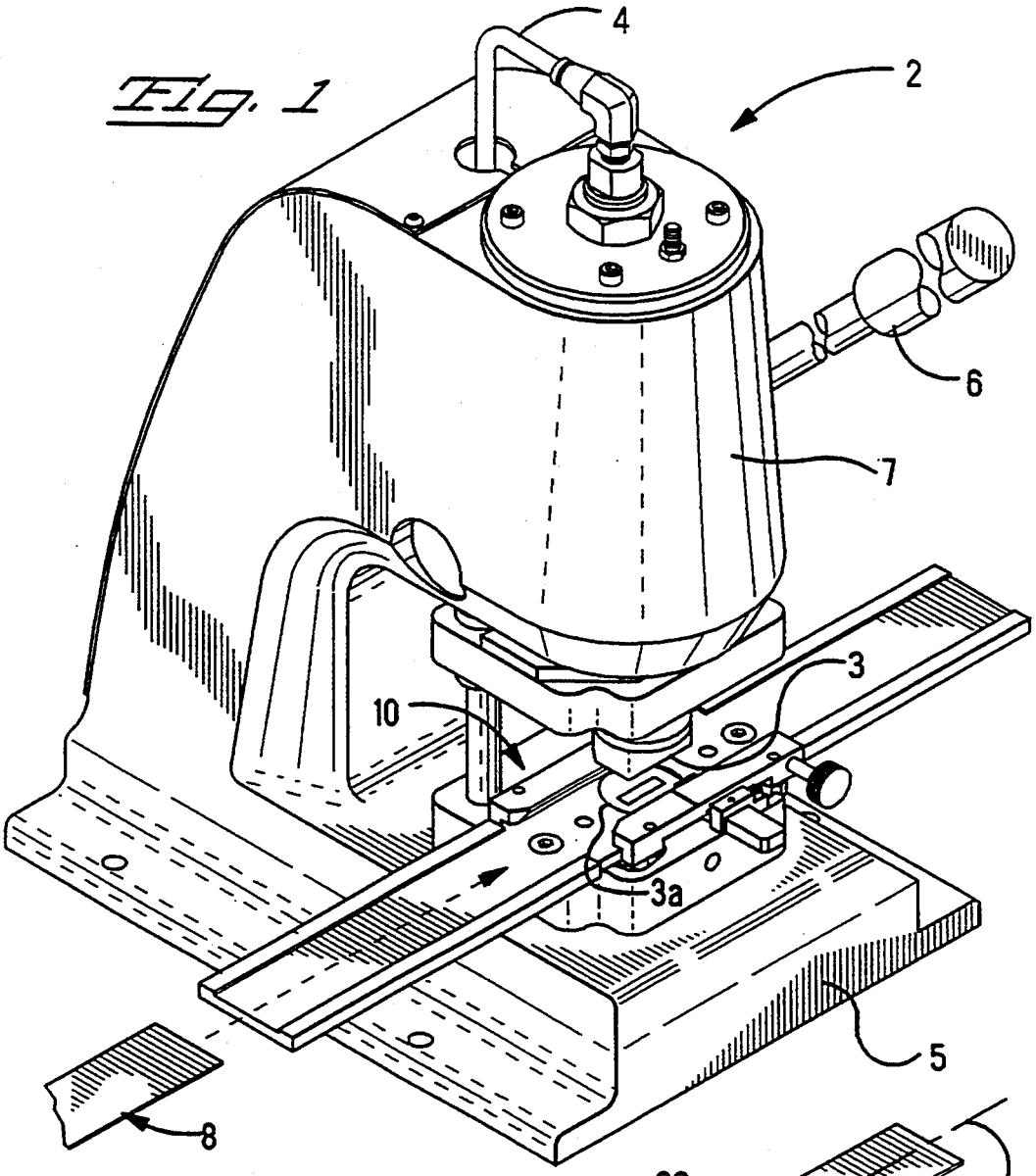
FIG. 1 is a perspective view of an apparatus according to the invention installed in an applicator frame for punching a slot in flat cable.

With reference to FIG. 1, an apparatus for laterally positioning flat cable is shown generally as 10 installed on a representative applicator frame 2 which is operable to perform a punching operation on a flat cable 8. The applicator frame 2 includes a base 5 which supports a workpiece such as the cable 8, and a head 7 which houses an actuation cylinder having a reciprocable ram. A punch 3 is attached beneath the reciprocable ram. Pneumatic or hydraulic pressure is delivered through conduit 4 to the actuation cylinder to drive the ram and the punch 3 downwardly toward die 3*a* which is constrained on the base 5 in opposition to the punch 3. Alternatively, an applicator frame of similar form excepting with a handle 6 to enable manual actuation of the ram and the punching die may be used.

Figure 2:
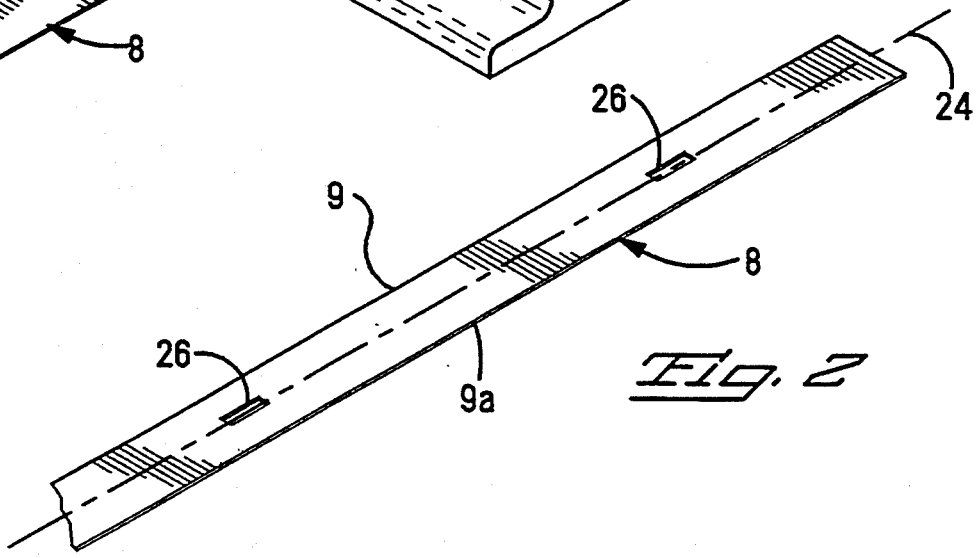
FIG. 2 is a perspective view of a flat cable of the type with which the invention can be used.

As shown in FIG. 2, the flat cable 8 with which the positioning apparatus can be used has a longitudinal cable axis 24 and a cable width which extends in a cable plane between opposite side edges 9, 9*a*. Slots 26 are punched in the cable 8 by an appropriately shaped punch 3 in the applicator frame 2. The slots 26 may be longitudinally disposed at any location along the cable axis 24, including at the ends of the cable 8. The slots 26 must be laterally positioned in the cable 8 to within a close tolerance, for example, centers of the slots within 0.010 inch of the cable axis 24, regardless of the cable width.

With reference to FIGS. 1, 3, 4 and 8, the positioning apparatus 10 comprises a base 12 which is secured to the base 5 by fasteners (not shown) from the bottom of the base 5. The apparatus may optionally comprise a track 42 which is secured to the base 12 by threaded fasteners 46. The track 42 extends through a work zone defined by a reciprocation path of the punch 3. The track 42 has pairs of opposed shoulders 44 and 45, opposite shoulders of each pair being spaced apart by a distance selected to be greater than the maximum width of the cable 8 which is to be operated on by the applicator frame 2 so that the cable 8 can be loosely received between the opposed shoulders 44 and 45. The track 42 is arranged to support the cable 8 and guide it to the work zone when the cable 8 is introduced to the applicator frame 2 from a side thereof, as shown in FIG. 1. However, the track 42 is not a necessary element of the present invention, as the cable 8 may be supported directly on the base 12 in the work zone beneath the punch 3. The track 42 has an aperture 64 which, along with a relief 68 in the base 12, permits passage of the punch 3 during piercing of the cable 8 when it is disposed in the work zone.

The positioning apparatus further comprises a pair of cable guides 16, 16*a* which are movable with respect to the base 12. The cable guides 16, 16*a* have respective cable guide surfaces 20, 20*a* which are in opposing relationship. Each of the cable guide surfaces 20, 20*a* is configured complementary to a respective one of the side edges 9, 9*a* of the cable 8 whereby the cable 8 may be confined therebetween. The cable guide surfaces 20, 20*a* are also preferably angled as shown in the drawings to provide a vertical component of holding force on the cable 8.

The cable guides 16, 16*a* are connected by a pivotal linkage which is operable to move the cable guide surfaces 20, 20*a* convergently and divergently through respective proportional distances on opposite sides of a target plane of convergence 50 which extends perpendicular to a plane of motion of the guide surfaces 20, 20*a*. When the cable 8 is confined between the guide surfaces 20, 20*a*, the cable axis 24 is accurately aligned parallel to the target plane of convergence 50. By positioning the apparatus 10 on the applicator frame 2 such that the target plane of convergence 50 is precisely aligned with respect to the reciprocation axis of the punch 3, the cable axis 24 is accurately aligned laterally with respect to the punch 3.

In the embodiment shown in FIGS. 4–7, the linkage is operable to move the guide surfaces 20, 20*a* convergently and divergently in equal increments, and the target plane 50 is defined centrally between the guide surfaces 20, 20*a*. The linkage comprises a pair of links 52 which reside in recesses 14 of the base 12. Each of the links 52 has a pivot post 54 which is pivotally received in a respective aperture 48 defined by the track 42 so as to define a pivot axis for each of the links. If the track 42 is to be omitted from the apparatus, the link pivot posts 54 could be received in respective apertures defined by the base 12. The pivot axes extend in a link pivot plane which is parallel to the target plane 50 and, in the illustrated embodiment, coincides therewith.

Each of the cable guides 16, 16*a* has a pair of pivot posts 18, 18*a*, respectively, which are received in respective pairs of apertures 56, 56*a* defined by ends of the links 52, each pivot post being retained in its respective aperture by a respective retaining ring. In the embodiment shown in FIGS. 4–7, the apertures 56, 56*a* are all equidistant from their respective pivot axes defined by the pivot posts 54 of their respective links 52. In this case the apparatus 10 may be arranged such that the target plane 50 coincides with the reciprocation axis of the punch 3 in order that the slots 26 may be punched precisely on center with the cable axis 24. Alternatively, the apparatus 10 could be arranged such that the target plane 50 is aligned at some distance offset from the reciprocation axis of the punch 3 in order that the slots 26 are punched at a precise location offset from the cable axis 24. In either case, the guide surfaces 20, 20*a* extend parallel to each other on opposite sides of the target plane 50. As the links 52 are pivoted on their respective pivot axes defined by the pivot posts 54, the guide surfaces 20, 20*a* are moved convergently or divergently with respect to the target plane 50 while remaining parallel to each other.

The apparatus may include biasing means for urging the guide surfaces 20, 20*a* convergently. Such biasing means may comprise compression springs 36 which have one of their ends confined in pockets 15 defined by the recesses 14 and the other of their ends confined in reliefs 34 defined by the links 52.

A grip 38 is provided to facilitate movement of the linkage against the bias of the springs 36. By displacing the grip 38 the guide surfaces 20, 20*a* may be moved sufficiently far apart to permit introduction of a cable 8 therebetween. The grip 38 may be, for example, a threaded member which engages in a complementary threaded hole 22 of the cable guide 16*a*. Alternatively, a displacing force may be applied directly to the cable guides 16, 16*a* if they are accessible.

Figure 3:
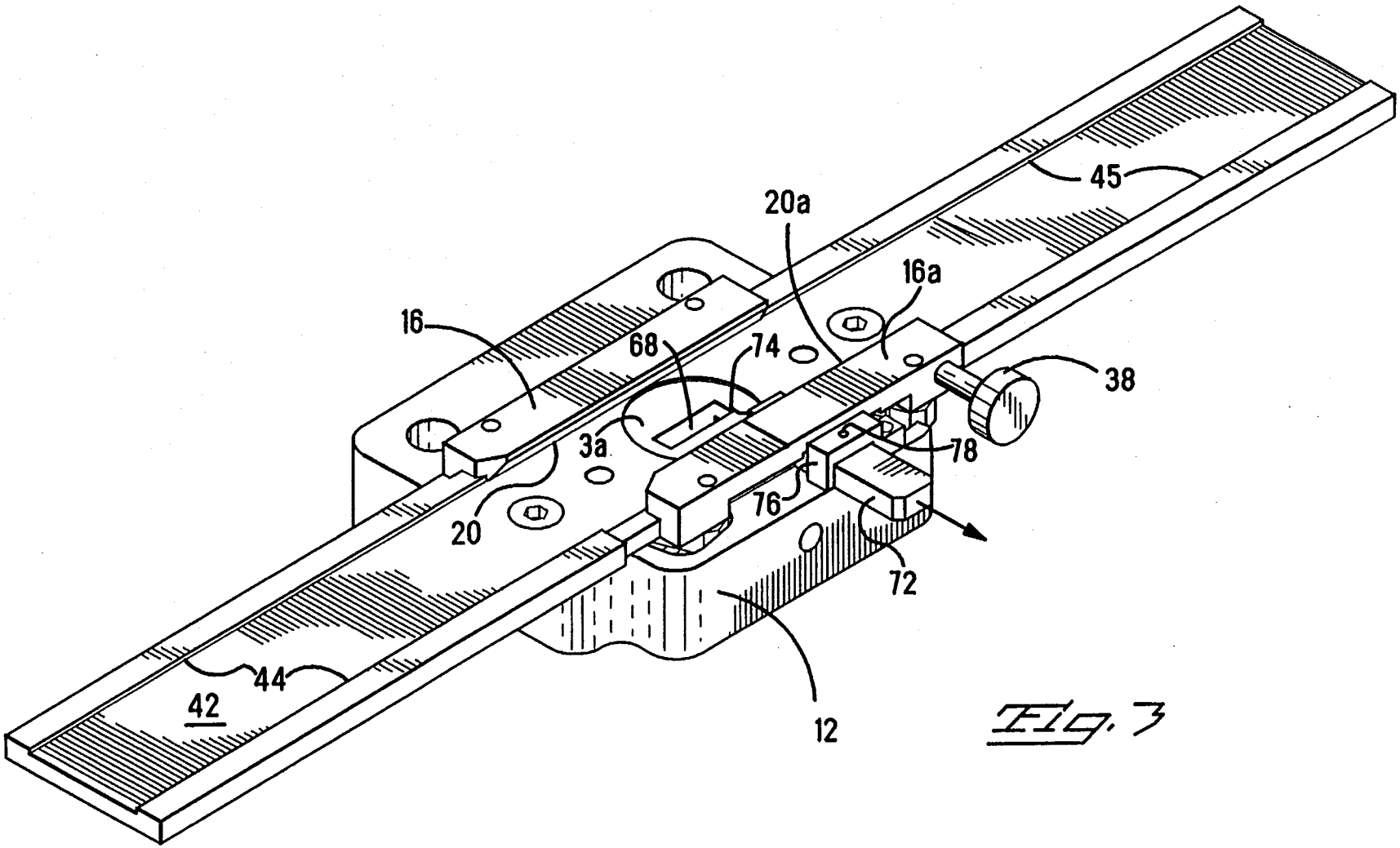
FIG. 3 is an enlarged perspective view of an apparatus according to the invention.
Figure 4:
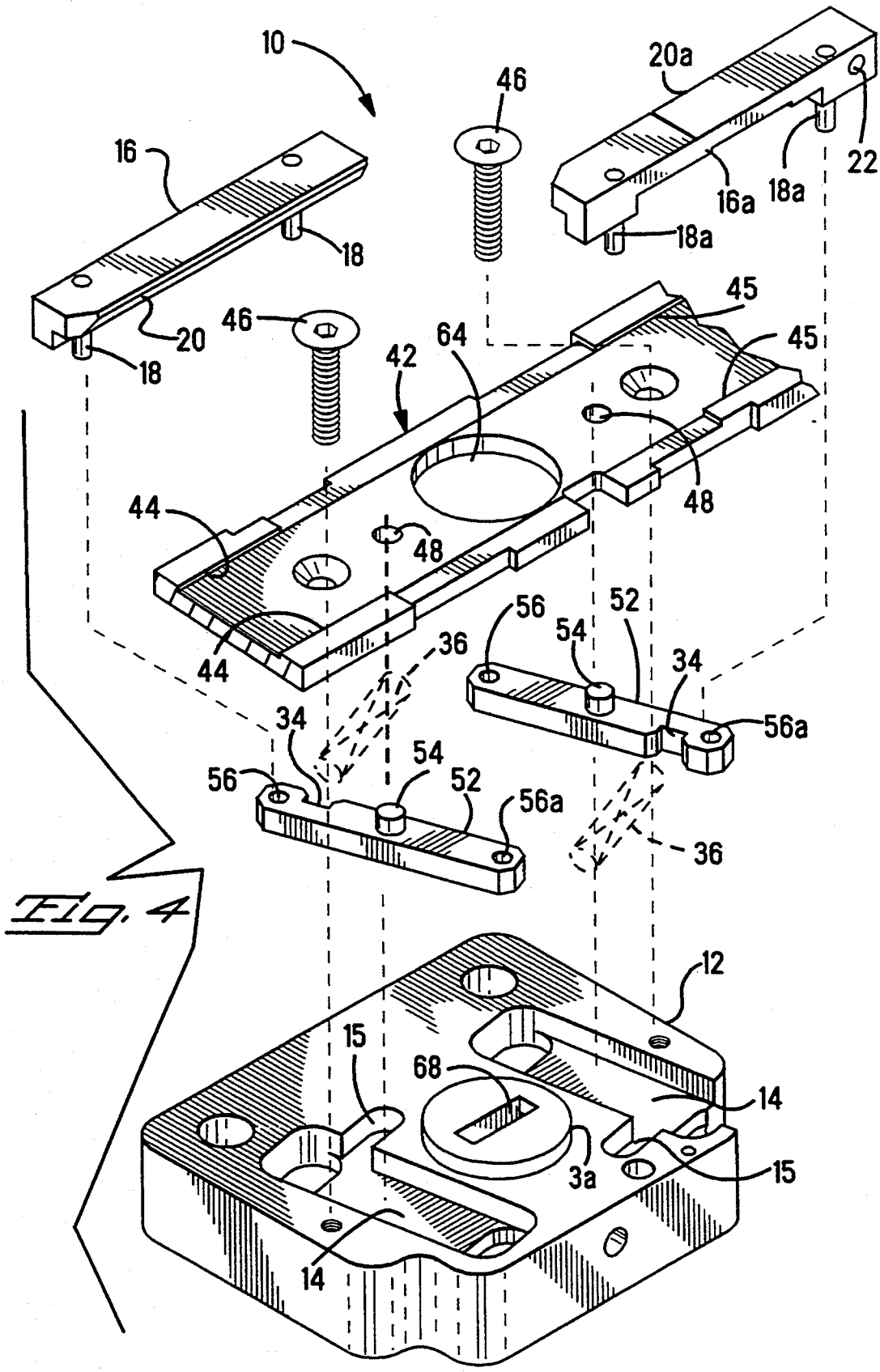
FIG. 4 is an exploded view of the apparatus according to the invention.
Figure 5:
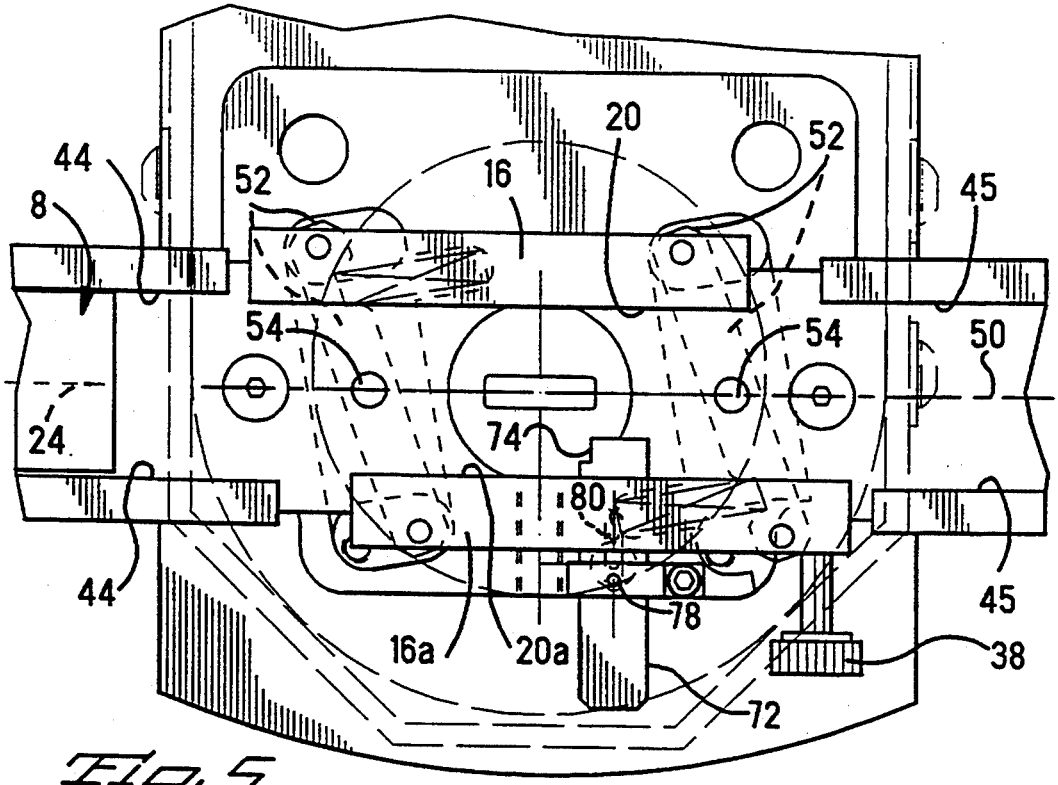
FIG. 5 is a top view of the apparatus having cable guides in a normal, closed position.

As best seen in FIGS. 3 and 5, the apparatus may have a stop 72 which has a notched end 74 configured to engage an end of the cable 8 and disposed so as to longitudinally position the end of the cable 8 in the work zone for punching a slot 26 therein. The stop 72 is slidable within guide 76 so that the notched end 74 can be withdrawn from the path of the cable 8 to allow passage of the cable 8 through the work zone. A pin 78 of the guide 76 is received in a slot 80 of the stop 72 to prevent complete withdrawal of the stop 72 from the apparatus. The stop 72 is shown in a withdrawn position in FIG. 7.

FIG. 5 is a top view illustrating a normal position of the cable guides 16, 16*a* for the apparatus having biasing springs according to the invention. The springs 36 urge the links 52 counterclockwise and thereby urge the guide surfaces 20, 20*a* relatively together.

Figure 6:
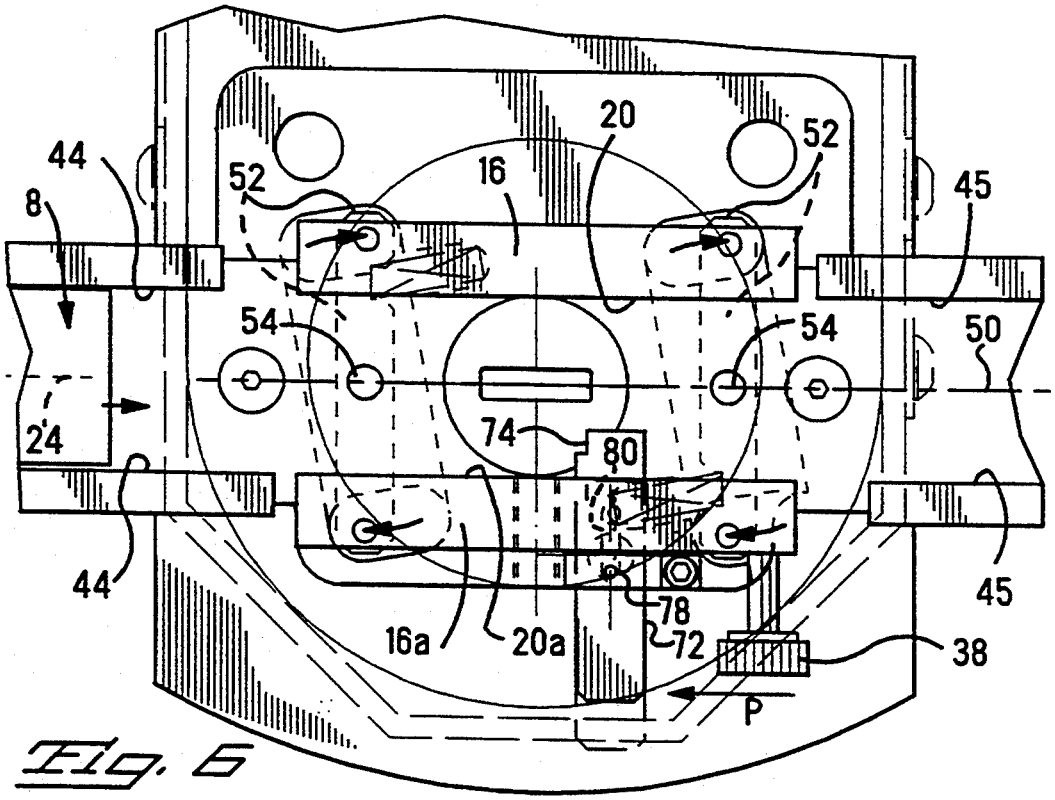
FIG. 6 is a top view showing the cable guides moved divergently to an open position.
Figure 7:
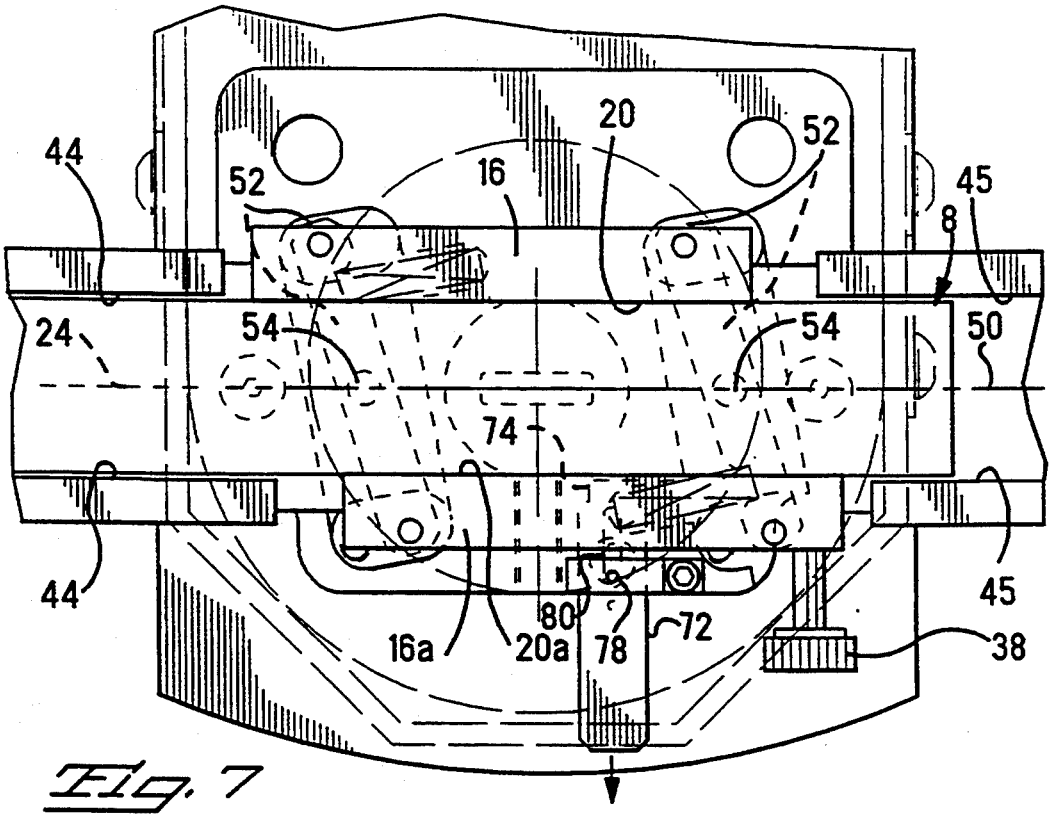
FIG. 7 is a top view showing the cables guides moved convergently and confining a cable therebetween.
Figure 8:
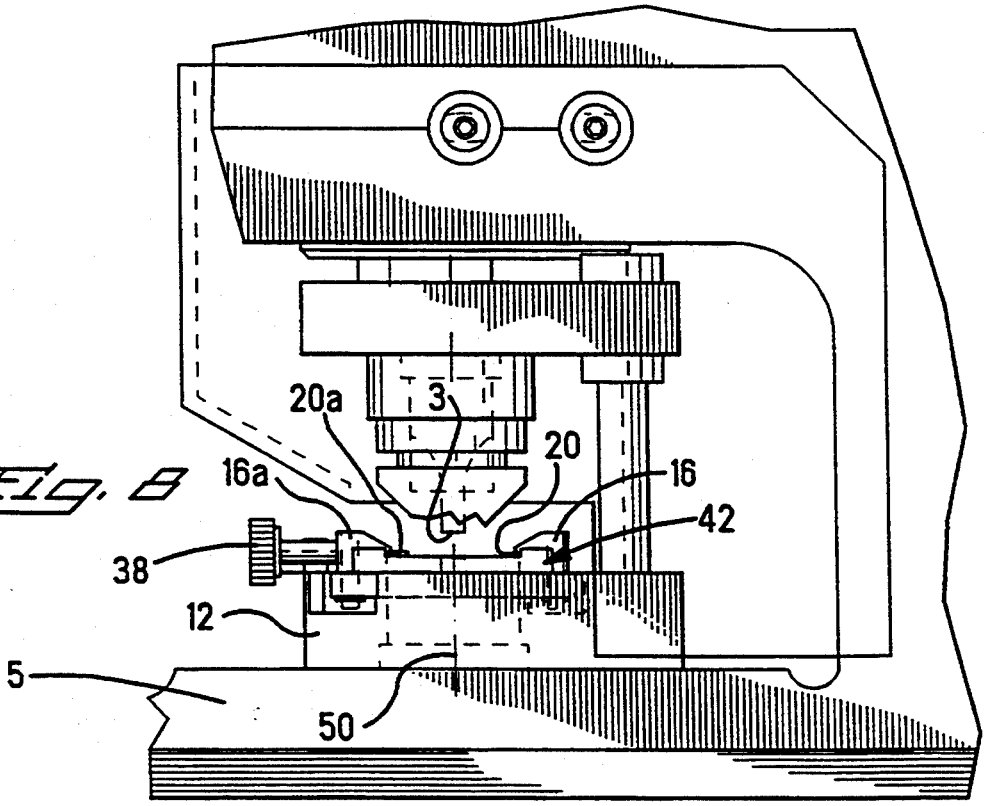
FIG. 8 is a side view of the apparatus installed in an applicator frame.

FIG. 6 is a top view illustrating the guide surfaces 20, 20*a* having been moved relatively apart such as would occur by an operator pushing on the grip 38 in the direction of arrow P. In this position, the cable guide surfaces 20, 20*a* are separated by a distance sufficient to permit the operator to insert the cable 8 therebetween. The operator then releases the grip 38 to permit the guide surfaces 20, 20*a* to engage the side edges 9, 9*a* of the cable 8 due to the bias of the springs 36, is shown in FIG. 7. The cable 8 is now confined between the guide surfaces 20, 20*a*. Further, the convergence of the guide surfaces 20, 20*a* on the target plane 50 causes the cable axis 24 to become aligned in the target plane. Since the target plane 50 has been previously aligned to coincide with the reciprocation axis of the punch 3 as shown in FIG. 8, the slots 26 can be punched precisely in the center of the cable 8.

In a variation of the above-described embodiment, the apertures 56 are disposed equidistant from their respective pivot posts 54 at a first distance, and the apertures 56*a* are disposed equidistant from their respective pivot posts 54 at a second distance different from the first distance, for example, one-half the first distance. In this case operation of the linkage moves the guide surfaces 20, 20*a* convergently such that the guide surface 20 moves incrementally twice as far as the guide surface 20*a*, and the target plane 50 is defined at a location which is two-thirds of the distance from the guide surface 20 to the guide surface 20*a*. With the apparatus 10 arranged in the applicator frame such that target plane 50 coincides with the reciprocation axis of the punch 3, confining the cable 8 between the guide surfaces 20, 20*a* would align the cable such that the cable axis 24 is laterally offset from the reciprocation axis of the punch 3. In this example a slot punched in the cable 8 would be centered along a longitudinal line which is one-third of the cable width inward from the cable side edge 9*a*. Other proportional distances of the apertures 56 and 56*a* from their respective pivot posts 54 could be selected to provide an infinite variation in the location of the target plane 50 between the boundaries defined by the guide surfaces 20, 20*a*, and thus slots could be accurately punched at any location across the cable width.

An apparatus according to the invention has the advantage of providing a simple mechanism for laterally positioning flat cable in a machine, regardless of cable width. The apparatus can be aligned in a machine such that any selected location along a width of the cable from a side edge thereof can be aligned with a tool of the machine.

The invention having been disclosed, a number variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An apparatus for laterally positioning flat cable and performing an operation on the cable, the cable having a longitudinal cable axis and a width extending between opposite side edges which define a cable plane, the apparatus comprising:

a frame including a base;

a pair of cable guides movable with respect to the base, each of the cable guides having a cable guide surface configured complementary to a respective one of the cable side edges, the cable guide surfaces being in opposing relationship;

a linkage connected for moving the cable guide surfaces convergently and divergently through respective proportional distances on opposite sides of a target plane of convergence between the cable guide surfaces;

wherein when the cable guide surfaces are spaced apart at a distance equal to or greater than the cable width and the cable is introduced between the cable guide surfaces, operation of the linkage so as to move the cable guide surfaces convergently causes the cable width to become confined between the cable guide surfaces and the cable axis to become aligned parallel to the target plane;

a tool coupled to the frame and referenced with respect to the target plane; and, means for guided reciprocation of the tool toward and away from the base such that the tool engages the cable which is confined between the guide surfaces;

whereby the tool engages the cable at a selected location across the width of the cable.

2. The apparatus according to claim 1, wherein the linkage comprises a pair of links each pivotal with respect to the base about a respective link pivot axis, and the link pivot axes extend in a link pivot plane which is parallel to the target plane.

3. The apparatus according to claim 2, wherein the link pivot plane is coincident with the target plane.

4. The apparatus according to claim 2, wherein each of the links has a mid-portion and a pair of opposite end portions, the link pivot axis of each said link is disposed at its respective said mid-portion, and each of said cable guides has a pivotal connection with one of said end portions.

5. The apparatus according to claim 1, further comprising biasing means for urging the cable guide surfaces convergently.

6. The apparatus according to claim 4, wherein the biasing means comprises at least one spring.

7. The apparatus according to claim 1, further comprising a grip connected to one of the cable guides.

8. An apparatus for laterally positioning flat cable and performing an operation on the cable, the cable having a longitudinal cable axis and a width extending between opposite side edges which define a cable plane, the apparatus comprising:

a frame including a base;

a pair of links each having a mid-portion pivotally connected to the base about a respective link pivot axis, the link pivot axes extending in a link pivot plane;

a pair of cable guides each having a pair of spaced apart pivotal connections defining a pair of cable guide pivot axes, each of the pivotal connections coupling one of the cable guides to one of the links about its respective said cable guide pivot axis, the pairs of cable guide pivot axes being in respective planes on opposite sides of the link pivot plane and parallel thereto, each of the cable guides having a cable guide surface configured complementary to a respective one of the cable side edges, the cable guide surfaces being in opposing relationship on opposite sides of a target plane of convergence defined between the cable guide surfaces, the target plane of convergence being parallel to the link pivot plane;

wherein pivoting of the links about their respective link pivot axes moves the cable guide surfaces convergently and divergently through respective proportional distances, such that when the cable guide surfaces are spaced apart at a distance equal to or greater than the cable width and the cable is introduced between the cable guide surfaces, pivoting of the links so as to urge the cable guide surfaces convergently causes the cable width to become confined between the cable guide surfaces and the cable axis to become aligned parallel to the target plane;

a tool coupled to the frame and referenced with respect to the target plane; and, means for guided reciprocation of the tool toward and away from the base such that the tool engages the cable which is confined between the guide surfaces;

whereby the tool engages the cable at a selected location across the width of the cable.

9. The apparatus according to claim 8, wherein the link pivot plane is coincident with the target plane.

10. The apparatus according to claim 8, further comprising biasing means for urging the cable guide surfaces convergently.

11. The apparatus according to claim 10, wherein the biasing means comprises at least one spring.

12. The apparatus according to claim 8, further comprising a grip connected to one of the cable guides.

13. The apparatus according to claim 1, wherein the tool is a punch which impacts the cable during the reciprocation, whereby the punch drives a hole through the cable at a selected location across the width of the cable.

14. The apparatus according to claim 8, wherein the tool is a punch which impacts the cable during the reciprocation, whereby the punch drives a hole through the cable at a selected location across the width of the cable.

* * * * *